US011633322B1

(12) United States Patent
Harden et al.

(10) Patent No.: US 11,633,322 B1
(45) Date of Patent: Apr. 25, 2023

(54) CONVERTIBLE WHEELCHAIR

(71) Applicants: Leo Harden, Auburn, AL (US); Jerrell Harden, Banks, AL (US); Russell Harden, Banks, AL (US); Floyd Hicks, Ramah, AL (US)

(72) Inventors: Leo Harden, Auburn, AL (US); Jerrell Harden, Banks, AL (US); Russell Harden, Banks, AL (US); Floyd Hicks, Ramah, AL (US)

( * ) Notice: Subject to any disclaimer, the term of this patent is extended or adjusted under 35 U.S.C. 154(b) by 0 days.

(21) Appl. No.: 17/860,894

(22) Filed: Jul. 8, 2022

(51) Int. Cl.

| | |
|---|---|
| ***A61H 3/04*** | (2006.01) |
| ***A61G 5/08*** | (2006.01) |
| ***A61G 5/10*** | (2006.01) |
| ***A61H 3/02*** | (2006.01) |
| *A61H 3/00* | (2006.01) |

(52) U.S. Cl.
CPC ..... *A61H 3/04* (2013.01); *A61G 5/085* (2016.11); *A61G 5/0891* (2016.11); *A61G 5/1056* (2013.01); *A61H 3/0244* (2013.01); *A61H 2003/007* (2013.01); *A61H 2003/046* (2013.01); *A61H 2201/0107* (2013.01); *A61H 2201/0161* (2013.01); *A61H 2201/0192* (2013.01); *A61H 2201/1253* (2013.01); *A61H 2201/1619* (2013.01); *A61H 2201/1633* (2013.01); *A61H 2201/1671* (2013.01)

(58) Field of Classification Search
CPC .. A61H 3/04; A61H 3/0244; A61H 2003/046; A61H 2201/0107; A61H 2201/0161; A61H 2201/0192; A61H 2201/1253; A61H 2201/1619; A61H 2201/1633; A61H 2201/1671; A61G 5/085; A61G 5/0891; A61G 5/1056
See application file for complete search history.

(56) References Cited

U.S. PATENT DOCUMENTS

| | | | | |
|---|---|---|---|---|
| 1,307,058 | A * | 6/1919 | McGrath | A61H 3/04 135/85 |
| 4,076,304 | A | 2/1978 | Deucher | |
| 4,119,164 | A | 10/1978 | Fogg et al. | |
| 4,162,101 | A * | 7/1979 | McCague, Sr. | A61H 3/00 297/332 |
| 4,362,311 | A | 12/1982 | Bergman | |
| 4,506,930 | A | 3/1985 | Lambert | |
| 4,555,121 | A | 11/1985 | Lockard et al. | |
| 4,598,944 | A | 7/1986 | Meyer et al. | |

(Continued)

FOREIGN PATENT DOCUMENTS

| | | |
|---|---|---|
| CN | 200977236 Y | 11/2007 |
| CN | 201814751 U | 5/2011 |

(Continued)

*Primary Examiner* — Steve Clemmons
(74) *Attorney, Agent, or Firm* — Sterne, Kessler, Goldstein & Fox P.L.L.C.

(57) ABSTRACT

A convertible wheelchair is provided. The convertible wheelchair can have a wheelchair configuration and a walker configuration to allow a user to alternately sit and stand, and can include a frame supporting a chair. The chair can be foldable and can include a chair back and a chair seat. The convertible wheelchair can include support and stability mechanisms accessible in the wheelchair configuration and the walker configuration including one or more torso supports, a fall seat, and stability bars.

19 Claims, 13 Drawing Sheets

(56) References Cited

U.S. PATENT DOCUMENTS

| | | | | |
|---|---|---|---|---|
| 4,623,194 | A | 11/1986 | Pillot | |
| 4,807,870 | A * | 2/1989 | Hickman | A61H 3/04 482/142 |
| 5,137,102 | A | 8/1992 | Houston et al. | |
| 5,224,721 | A * | 7/1993 | Santmann | A61H 3/04 280/87.051 |
| 5,265,689 | A | 11/1993 | Kauffmann | |
| 5,364,120 | A * | 11/1994 | Shimansky | A61G 5/1091 280/87.041 |
| 5,366,036 | A | 11/1994 | Perry | |
| 5,419,571 | A * | 5/1995 | Vaughan | A61G 5/1054 280/250.1 |
| 5,451,193 | A * | 9/1995 | Pickard | A61H 3/04 482/68 |
| 5,558,358 | A * | 9/1996 | Johnson | A61G 5/0891 280/87.021 |
| 6,231,067 | B1 | 5/2001 | Johnson et al. | |
| 6,338,493 | B1 * | 1/2002 | Wohlgemuth | A61G 5/00 280/30 |
| 6,343,802 | B1 | 2/2002 | Workman et al. | |
| 6,371,142 | B1 * | 4/2002 | Battiston | A61H 3/04 135/66 |
| 6,431,572 | B1 | 8/2002 | Harden et al. | |
| 6,547,112 | B2 * | 4/2003 | Gallagher | B60R 11/00 224/407 |
| 6,619,681 | B2 | 9/2003 | Gutierrez | |
| 7,040,637 | B2 * | 5/2006 | Owens | A61H 3/04 135/85 |
| 7,100,716 | B2 | 9/2006 | Engels et al. | |
| 7,669,863 | B2 * | 3/2010 | Steiner | A61H 3/04 280/648 |
| 7,673,888 | B2 * | 3/2010 | Lauren | A61G 5/00 280/47.24 |
| 7,815,209 | B2 | 10/2010 | Porcheron | |
| 8,104,835 | B2 | 1/2012 | Ovre et al. | |
| 8,584,689 | B2 * | 11/2013 | Catton | A61H 3/04 135/67 |
| 9,565,947 | B2 | 2/2017 | Oblak et al. | |
| 9,655,806 | B2 * | 5/2017 | Naucke | A61G 5/1013 |
| 9,662,264 | B2 * | 5/2017 | Jacobs | A61H 3/04 |
| 9,962,303 | B1 * | 5/2018 | Wilson | A61G 5/1054 |
| 10,080,699 | B2 * | 9/2018 | Schraudolph | A61H 3/04 |
| 10,292,893 | B2 * | 5/2019 | VanAusdall | B62B 5/0438 |
| 11,285,059 | B1 * | 3/2022 | Alexander | A61G 5/14 |
| 11,471,361 | B2 * | 10/2022 | Bardgett | A61G 5/02 |
| 2007/0283990 | A1 * | 12/2007 | Fernandez | A61G 5/128 280/87.041 |
| 2011/0006494 | A1 * | 1/2011 | Walker | A61G 5/08 280/7.17 |
| 2013/0168931 | A1 * | 7/2013 | Baraitaru | A61G 5/08 280/30 |
| 2013/0207354 | A1 * | 8/2013 | Gardner | A61H 3/04 280/5.2 |
| 2020/0206067 | A1 * | 7/2020 | Hanson | A61G 5/14 |
| 2021/0015690 | A1 | 1/2021 | You | |
| 2021/0228433 | A1 * | 7/2021 | Landry | A61B 5/1117 |

FOREIGN PATENT DOCUMENTS

| | | | | |
|---|---|---|---|---|
| CN | 108969314 | A | 12/2018 | |
| CN | 111388218 | A * | 7/2020 | A61G 5/00 |
| CN | 112704606 | A * | 4/2021 | |
| EP | 1523970 | B1 | 4/2005 | |
| GB | 1139796 | A | 1/1969 | |
| GB | 2340388 | B | 11/2001 | |
| GB | 2519228 | B | 4/2015 | |
| JP | 6308565 | B2 | 4/2018 | |
| KR | 101852149 | B1 | 4/2018 | |
| WO | 90/08669 | A1 | 8/1990 | |
| WO | 2004/047707 | A2 | 6/2004 | |
| WO | 2017/199164 | A1 | 11/2017 | |

* cited by examiner

CONVERTIBLE WHEELCHAIR

BACKGROUND OF THE INVENTION

Field of the Invention

The present invention relates to wheelchairs. In particular, the present invention relates to wheelchairs that are capable of converting to and from walkers. Additional embodiments include walkers, or other mobility devices.

Background

Assistive devices are essential tools that provide people who require support the ability and independence to conduct their daily lives. These users may be elderly members of society, for example, or those with temporary or permanent physical ailments. Wheelchairs are assistive devices that provide mobility and can be customized to provide various support aspects to users. For example, wheelchairs can be user-operated such that a user can propel and navigate the wheelchair independently. The user can access brakes to stop the wheelchair, such as to leave the wheelchair or when the user will be stationary for an extended period of time. The user can alternately release the brake to facilitate mobility. Additionally, wheelchairs can provide comfort with cushioning and adjustments to fit different users.

As the aging population grows and technology advances, innovation in assistive devices is a natural and needed development. However, improvements to available wheelchairs have been limited. Users require advanced mobility that allows them to both sit and stand. A walker is a separate assistive device that provides walking mobility by acting as a frame to support a user. Wheelchairs that are convertible to walkers exist, but can be complicated, as well as difficult to use and ineffective. For example, in walker configurations, the user may be positioned uncomfortably, which may stall mobility. In addition, the design of the wheelchair may impede freedom of movement in the walker configuration. These and other issues can compromise independence. The transition from a wheelchair configuration to a walker configuration can be complex as well, requiring multiple people for conversion. Accordingly, a need exists for advanced assistive devices that provide users with mobility and independent operation.

BRIEF SUMMARY OF THE INVENTION

Some embodiments relate to convertible wheelchair having a wheelchair configuration and a walker configuration. In some embodiments, the convertible wheelchair includes a frame, a chair supported by the frame including a chair back and a chair seat rotatably coupled to the chair back, the chair seat positioned at an angle relative to the chair back in the wheelchair configuration and positioned adjacent to the chair back in the walker configuration. In some embodiments, the convertible wheelchair includes a torso support attached to and extending from a bottom surface of the chair seat, the torso support configured to secure around a front of a torso.

In some embodiments, the convertible wheelchair includes a fastener configured to maintain the chair seat adjacent to the chair back in the walker configuration. In some embodiments, the fastener is further configured to releasably couple to the frame to maintain the chair seat adjacent to the chair back in the walker configuration.

In some embodiments, the convertible wheelchair includes a second torso support configured to secure around a front of a torso. In some embodiments, the torso support is a first torso support and is configured to secure around an abdomen region, and the second torso support is positioned above the first torso support. In some embodiments, two opposing ends are configured to extend to a front of a torso.

In some embodiments, the torso support further includes a belt extending from the opposing ends, the belt configured to secure the torso support around the front of the torso.

Some embodiments relate to a convertible wheelchair having a wheelchair configuration and a walker configuration, the convertible wheelchair including a foldable chair including a chair back and a chair seat coupled to the chair back, the chair seat adjustable to be positioned adjacent to the chair back in the walker configuration, an elevating mechanism coupled to the chair back, the elevating mechanism configured to vertically displace the chair in both the wheelchair configuration and the walker configuration.

In some embodiments, the elevating mechanism is configured to vertically displace the foldable chair in both an unfolded position and a folded position of the foldable chair. In some embodiments, the convertible wheelchair includes a torso support configured to secure around a front of a torso, the torso support attached to and extending from the chair seat. In some embodiments, the elevating mechanism is further configured to vertically displace the foldable chair to position the torso support at an abdomen region of a user of the convertible wheelchair in the walker configuration.

In some embodiments, the convertible wheelchair includes a crutch positioned adjacent to the chair back. In some embodiments, the convertible wheelchair includes a torso support coupled to the crutch and configured to secure around a front of a torso.

In some embodiments, the convertible wheelchair includes opposing stability bars positioned below the foldable chair and extending parallel to the chair seat in an unfolded position of the foldable chair, the opposing stability bars configured to provide stability support to a user of the convertible wheelchair in the wheelchair configuration.

In some embodiments, the foldable chair is removably coupled to a frame of the convertible wheelchair such that the convertible wheelchair is modular.

Some embodiments relate to a foldable chair for a mobility device, the foldable chair including a chair back and a chair seat coupled to the chair back, the chair seat configured to support a user of the of the convertible wheelchair seated of the wheelchair configuration and to rotate to move the foldable chair between a folded position and an unfolded position, wherein when the user stands up, the chair seat automatically moves towards the chair back away and upward such that the user may stand in the space previously occupied by the chair seat.

In some embodiments, the chair seat includes an actuator configured to maintain the foldable chair in the folded position.

In some embodiments, a fall seat is biased to be positioned adjacent to the chair seat.

In some embodiments, the foldable chair includes a torso support configured to secure around a front of a torso, the torso support attached to and extending from the chair seat.

In some embodiments, the torso support is attached to the chair seat at a position above a fall seat.

BRIEF DESCRIPTION OF THE DRAWINGS/FIGURES

The accompanying drawings, which are incorporated herein and form part of the specification, illustrate embodiments and, together with the description, further serve to explain the principles of the embodiments and to enable a person skilled in the relevant art(s) to make and use the embodiments.

Figure 1:
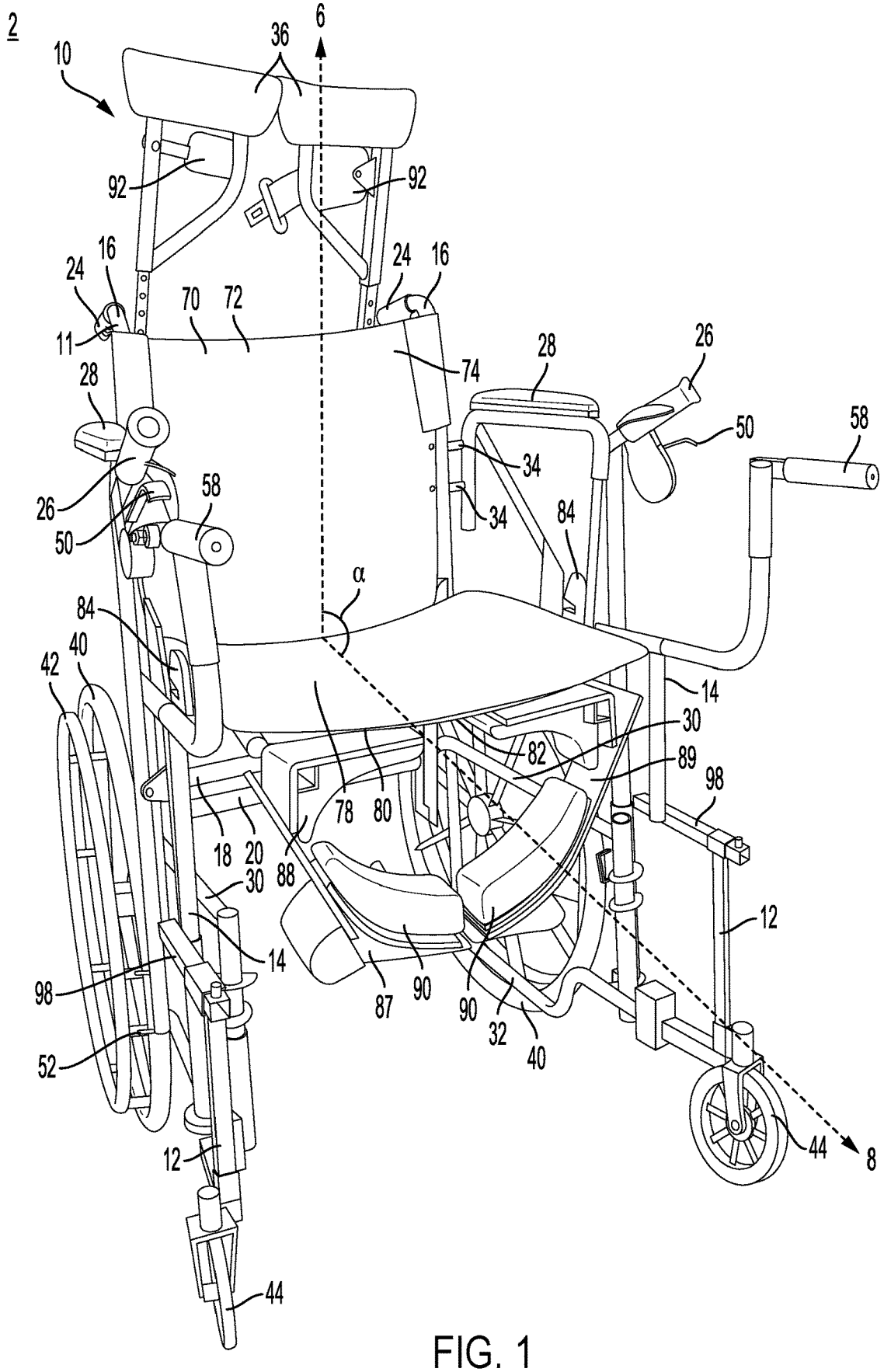
FIG. 1 shows a perspective view of a convertible wheelchair according to some embodiments.

The features and advantages of the embodiments will become more apparent from the detail description set forth below when taken in conjunction with the drawings, in which like reference characters identify corresponding elements throughout. In the drawings like reference numbers generally indicate identical, functionally similar, and/or structurally similar elements.

DETAILED DESCRIPTION OF THE INVENTION

The present inventions will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present inventions. Other suitable modifications and adaptations of the variety of conditions and parameters normally encountered in the field, and which would be apparent to those skilled in the art, are within the spirit and scope of the inventions.

As used herein, the term "approximately" is inclusive of the number to which it refers and includes numbers that bound and are within a range of 10-15% except where such number would exceed 100% of a possible value.

Systems and methods described herein are directed to a convertible wheelchair having a wheelchair configuration and a walker configuration. The wheelchair configuration can provide a user with mobility while seated. Similarly, the walker configuration can provide mobility to the user in a standing position. The convertible wheelchair system can easily be converted to the wheelchair configuration or the walker configuration. For example, one person, who may be the user, can independently convert the system. The system may be used and converted by users who have physical limitations or impairments, including those who have limited or no use of their arms. Additionally, the convertible wheelchair can be quickly disassembled to provide modularity for transport or storage. The improved functioning and construction of the convertible wheelchair facilitate dynamic mobility for users while enabling comfortable and independent operation.

The convertible wheelchair can include a chair that can be adjusted to fit a user in the wheelchair configuration. The chair can be raised and lowered depending on the user's desired positioning. The chair can be foldable and can include a chair back and a chair seat. In the wheelchair configuration, the chair back and the chair seat can extend generally perpendicularly relative to each other. In this way, the chair back and chair seat create a chair in which the user can sit. The user can propel the convertible wheelchair forward while seated. Accordingly, the convertible wheelchair in the wheelchair configuration provides the user with mobility while seated.

To convert the convertible wheelchair from the wheelchair configuration to the walker configuration, the user can rotate the chair seat such that it is adjacent to the chair back. In this way, the chair can be foldable to allow for rotation of the chair seat relative to the chair back. The user can stand within the convertible wheelchair in the walker configuration in the space previously occupied by the chair seat. In some embodiments, the chair can include a fastener to maintain the chair seat in a position that is adjacent to the chair back. Because the chair is folded, the user benefits by having additional room to move within the convertible wheelchair. Folding the chair advantageously limits the vertical extension of the chair, which provides the user with space behind their upper legs, for example. In contrast, unfolding the chair such that the chair seat becomes coplanar with the chair back adds vertical extension. Unfolding a chair outwardly and creating vertical extension may obstruct a user's legs, impeding movement.

Embodiments described herein provide mobility in both seated and standing positions. The convertible wheelchair can be quickly and easily converted between the wheelchair configuration and the walker configuration, allowing for dynamic mobility such that users can adapt to the demands of daily life. For example, a user may wish to be seated to travel to a destination without risking injury or overexertion. However, when the user is in one location for an extended period of time, they may wish to stand and/or walk for exercise and general physical and mental health. Further, a user may participate in rehabilitation exercises in which intermittent walking mobility is desirable to build gait mobility, strength, or stamina. Additionally, the user may wish to stand to reach a higher placed or overhead item as they conduct their daily life. A user may also wish to stand to interact at eye level with others who are standing. By providing the ability to stand and walk, the user may feel a sense of dignity or self-esteem. Accordingly, the convertible wheelchair provides flexibility for users and allows them to effectively and efficiently conduct their daily lives.

As will be described herein, the chair seat can have a bottom surface from which a torso support can extend. The torso support can secure around a front of a torso of the user. As in the wheelchair configuration, the chair can be adjustable in the walker configuration. For example, the chair can be raised to position the torso support at the vertical level of an abdomen region of the user when standing. The torso support can secure around the abdomen region, and can extend to the front of the torso of the user. In this way, the convertible wheelchair can support and stabilize the user in the walker configuration while providing freedom of movement in a standing position.

Injury risk prevention when standing or walking is critical for elderly users, as they can be vulnerable to hip injuries from falling, other bone fractures, and even brain injuries. Assistive devices, such as wheelchairs and walkers that tip or fall can cause users to sustain one or more of these injuries. As an assistive device increases in height, a stronger base is required to provide balance and stability. Recognizing that users have different physical needs, the convertible wheelchair can provide support as desired. For example, the torso support can secure around an abdomen region of the user and can extend around a front of the user's torso to reduce the risk of the user tipping or falling forward in the walker configuration. Some users, such as elderly users and patients who struggle with walking mobility, desire, and may require, advanced support to remain upright and feel secure. This can provide them with the confidence to continue standing or walking. For additional support, embodiments provide a second torso support that can extend around a chest area of the user. The second torso support, alone or in combination with the abdomen region torso support, can retain a user if they begin to tip or fall. In this way, a user does not need to actively grasp a structure to stop from tipping or falling.

In some embodiments, a movable seat is provided to catch the user if they fall. The movable seat can be secured to the chair seat and can rotate outwardly by the user's falling action. By rotating outwardly, the movable seat can extend generally perpendicularly relative to the chair seat, as the chair seat is maintained in a position adjacent to the chair back. The movable seat can rotate outwardly to catch the user if they fall. In this way, the convertible wheelchair described herein can provide multiple securing and stabilizing mechanisms to support the user as they stand and walk. In addition, the user may decide to sit while they are standing or walking to rest. The movable seat can be deliberately rotated outwardly by the user to provide a seat for the user if they decide to rest, for example. As the user returns to a standing position, the movable seat can be rotated to return to a position adjacent to the chair seat. The user can then stand and move in the space previously occupied by the movable seat in the walker configuration.

In some embodiments, as a user enters and leaves the convertible wheelchair, structural aspects of the convertible wheelchair frame can provide additional stability and support. For example, bars extending forwardly and positioned lower to the ground can be used as leverage for the user as they transition from the chair of the convertible wheelchair to another seat (e.g., a car seat, a hospital wheelchair, a living room chair, etc.). These additional bars can prove a structural support for users to grasp as they transition into and out of the convertible wheelchair. Embodiments additionally provide a hand brake and a safety brake that can easily be engaged to stop movement of the convertible wheelchair. As the user transitions into and out of the convertible wheelchair and between the wheelchair and walker configurations, they may wish to immobilize the convertible wheelchair. Quick actuation of one or more brakes can provide further stability. Additionally, if the user anticipates falling as they are standing or walking, they can immediately actuate one or more brakes to stabilize the convertible wheelchair to reduce the risk of injury.

The convertible wheelchair can positively affect caregivers and healthcare professionals as well. Because users of the convertible wheelchair are able to support themselves in a range of positions, they gain independence, allowing caregivers and healthcare professionals to attend to other matters. Additionally, users experience less instability, which eases the physical duties caregivers and healthcare professionals sometimes have in order to support those who require assistive devices. The mental burden on these stakeholders from care and concern is also relaxed, as users of the convertible wheelchair are safe and self-sufficient.

Embodiments also provide modularity. As described herein, the chair can be removable. The frame can also be taken apart easily such that the convertible wheelchair can be compactly stored for transport. This configuration can be advantageous in applications where users require frequent transportation, such as for hospital or rehabilitation visits. In some embodiments, the convertible wheelchair can be provided in a kit. The kit can include the parts of the convertible wheelchair for assembly. In some embodiments, a conversion kit can be available with tools and/or parts to convert an existing wheelchair into the convertible wheelchair described herein.

Based on the foregoing, assistive devices, such as wheelchairs and walkers, are essential devices for providing freedom of mobility to users requiring additional support. The convertible wheelchair described herein can provide both seated and standing support to easily and effectively expand the user's mobility range. The convertible wheelchair will be described further with reference to the figures.

As shown in FIG. 1, a convertible wheelchair 10 can include a frame 11 and a chair 70. Frame 11 can support chair 70. Frame 11 can include rear vertical members 16, push handles 24, front handles 26, arm rests 28, intermediate horizontal members 30, lower horizontal members 32, and chair seat links 34. Chair seat links 34 can be intermediate to rear vertical members 16 and arm rests 28.

As shown, convertible wheelchair 10 can be in a wheelchair configuration 2. In wheelchair configuration 2, a user can be seated in chair 70 of convertible wheelchair 10. Chair 70 can include a chair back 72, a chair back front surface 74, a chair seat 78, a chair seat top surface 80, and a chair seat bottom surface 82. In wheelchair configuration 2, the user can sit directly on chair seat top surface 80 of chair seat 78. While seated, chair back 72 can provide back support. In some embodiments, chair back 72 can be angled such that the user leans back when seated in chair 70. This can help to reduce the risk of the user tipping or falling. In some embodiments, chair seat 78 may be configured to tilt or swing such that a user can sit or stand and chair seat 78 follows the point of contact of the user.

Chair back 72 can define a plane, in which an axis 6 lies. Additionally, chair seat 78 can define a plane, in which an axis 8 lies. Axis 8 can extend from axis 6 at an angle $\alpha$. In some embodiments, in wheelchair configuration 2, in which a user can be seated, angle $\alpha$ can be between approximately 70 degrees and approximately 120 degrees, such as between approximately 80 degrees and approximately 110 degrees, such as approximately 90 degrees. Accordingly, chair back 72 and chair seat 78 can extend generally perpendicularly relative to each other.

In some embodiments, chair seat 78 may function as a "fall seat," such that it may catch a user when falling. In some embodiments, chair seat 78 may be fixed in a single position. In some embodiments, chair seat 78 may be configured to raise at a rear portion and lower at a front portion, such that when a user stands, the chair seat 78 pivots and/or slides away towards chair back 72 such that the user can stand in the space previously occupied by chair seat 78. In some embodiments, actuators such as levers, arms, linkages, springs, dampers, motors, etc., may be included such that the chair seat 78 may move back and forth between a sitting position and a standing position, e.g., as a fall seat. In some embodiments, chair seat 78 pivots up or down such that the user may naturally position it when standing. In some embodiments, a seatbelt may be provided to secure user with respect to the chair back 72, such that it moves the pivot direction even when chair seat 78 may move out of the way, e.g., when the user stands. In this way, the seatbelt may control the movement of the chair seat 78, particularly when in use as a "fall seat," for example, when a point on the linkage is fastened to a seatbelt attachment point. In some embodiments, chair seat 78 slides (e.g., as a slide seat) backwards on a track/pin such that the user may naturally position it when standing. In some embodiments, a seatbelt may be provided to secure user with respect to the chair back 72, such that it moves along a track even when chair seat 78 may move out of the way, e.g., when the user stands. In this way, the seatbelt may control the movement of the chair seat 78, particularly when in use as a "fall seat."

In some embodiments, chair seat 78 may function as a "lift seat," such that it may assist a user with standing. In some embodiments, chair seat 78 may be configured to raise at a rear portion and slide rearward along a track, e.g., by use of an actuator such as levers, arms, linkages, springs, dampers, motors, etc., thereby assisting the user to stand up from a sitting position. In some embodiments, at the same time that the lift seat is actuating upward, one or more of crutches 36 on convertible wheelchair 10 may be automatically raised, further assisting the user in standing. Adjusting crutches 36 may include, for example, raising or lowering crutches 36 vertically, and shifting crutches 36 horizontally. In this way, even individuals that may not be able to stand on their own may be assisted with standing via convertible wheelchair 10, for example such that blood flow to the lower extremities may be increased, or a user may simply stand to perform tasks that otherwise would be difficult while sitting, for example. Even simply standing up to talk to another person is made possible for those who it may be difficult or otherwise impossible to do so.

In some embodiments, a roller may be included at the front edge of the chair seat 78, such that when pivoting from a standing to sitting configuration, or vice versa, the contact point between the user and the chair may easily translate as the user stands or sits. This is in contrast to a seat without a roller at the front edge, where friction between the user and the edge of the seat makes it harder to sit (or stand), while the user is in contact with chair seat 78.

In some embodiments, the chair seat 78 may automatically move out of the way when the user stands up, and may automatically move to a sitting position when the user sits. In some embodiments, a locking mechanism may be provided to lock one or more of the chair back 72 and chair seat 78 in position. In some embodiments, the chair back 72 and/or the chair seat 78 are adjustable in one or more dimensions to accommodate different user's anatomies (e.g., length and proportions of legs, arms, torso, etc.).

In some embodiments, convertible wheelchair 10 can also include brake handles 50, brakes 52, and safety handles 58. Frame 11 can also include front vertical members 12, brake members 14, and stability bars 98, and can support side wheels 40, outer wheels 42, and front wheels 44. In some embodiments, outer wheels 42 can extend outwardly from frame 11. By extending frame 11 at a lower portion of convertible wheelchair 10, outer wheels 42 can provide additional stability and balance to convertible wheelchair 10 to lower the risk of tipping or falling.

A user can independently operate convertible wheelchair 10. For example, convertible wheelchair 10 can be motorized such that a user can actuate a motor to propel convertible wheelchair 10. Additionally or alternatively, a second user can utilize push handles 24 to propel convertible wheelchair 10. Brake handles 50 and safety handles 58 can be actuated to engage brakes 52. Front wheels 44 can be supported by front vertical members 12. Stability bars 98 can extend from front vertical members 12. Brake handles 50, brakes 52, safety handles 58, and stability bars 98 will be described further below.

In some embodiments, convertible wheelchair 10 can include a lower torso support first end 88 and a lower torso support second end 89. Lower torso support first end 88 and lower torso support second end 89 can be opposing ends of a lower torso support and can be attached to chair seat bottom surface 82. In some embodiments, each of lower torso support first end 88 and lower torso support second end 89 can include one or more cushions 90. In some embodiments, one or more lower torso support belts 87 can extend from one or more of lower torso support first end 88 and lower torso support second end 89. In some embodiments, convertible wheelchair 10 can include one or more crutches 36. In some embodiments, crutches 36 can be positioned behind chair back 72. In some embodiments, crutches 36 can provide head and/or neck support for a user seated in wheelchair configuration 2. In some embodiments, crutches 36 can include cushioning to provide a comfortable head and/or neck support for the user. In some embodiments, crutches 36 can be removable. In some embodiments, crutches 36 can be fixed to convertible wheelchair 10. For example, crutches 36 can be fixed in position and prevented from being moved vertically or horizontally. In some embodiments, crutches 36 can be adjustable on convertible wheelchair 10. Adjusting crutches 36 on convertible wheelchair 10 can include raising or lowering crutches 36 vertically, and shifting crutches 36 horizontally. Lower torso support first end 88, lower torso support second end 89, cushions 90, lower torso support belts 87, and crutches 36 will be described further below.

Figure 2:
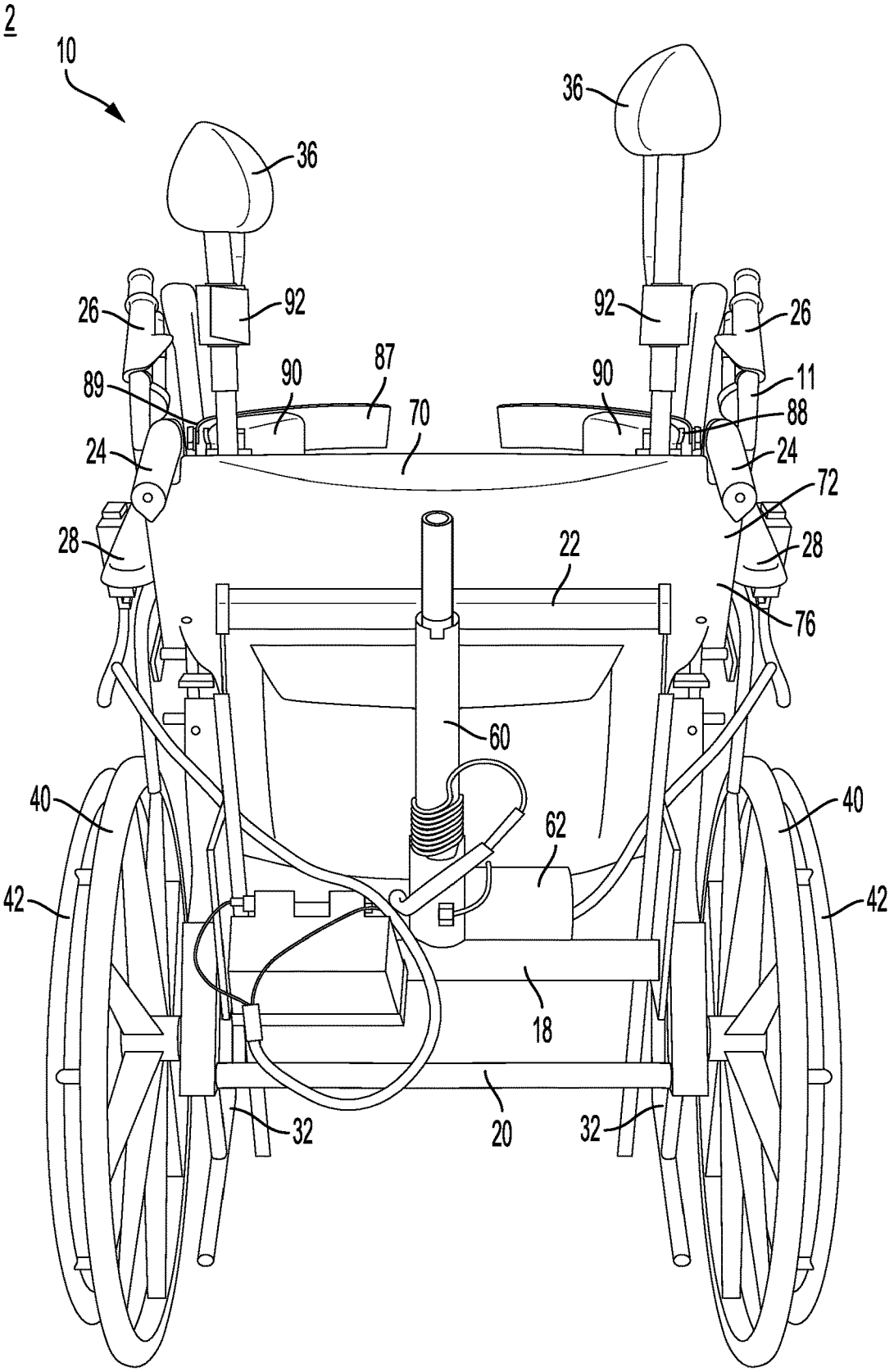
FIG. 2 shows a rear side view of the convertible wheelchair of FIG. 1.

Chair 70 can be supported by frame 11. As shown in FIG. 2, frame 11 can include an intermediate back member 18, a lower back member 20, and an upper back member 22. Chair back 72 can include a chair back rear surface 76. Upper back member 22 can support chair back 72. As shown, chair back rear surface 76 can be attached to upper back member 22. Lower back member 20 can provide horizontal structural support to convertible wheelchair 10. Convertible wheelchair 10 can include a rear cylinder 60 and an electric motor 62 supported by frame 11, which may serve as an elevating mechanism (and in some embodiments may be used as part of the "lift seat" as described herein). In some embodiments, rear cylinder 60 and electric motor 62 can be supported by intermediate back member 18 and/or upper back member 22. In some embodiments, rear cylinder 60 can be a linear actuator that can vertically displace chair 70. In some embodiments, rear cylinder 60 can be displaced by electric motor 62. In some embodiments, chair 70 can include this and/or other elevating mechanisms. In some embodiments, chair 70 can be displaced mechanically. In some embodiments, chair 70 can be adjusted vertically while convertible wheelchair 10 is in wheelchair configuration 2.

In some embodiments, chair 70 can be adjusted to better fit a user. For example, a taller user may require a greater distance between chair seat 78 and the ground to accommodate their longer legs. This user may raise chair 70 to increase the distance between chair 70 and the ground. Similarly, a shorter user may require a smaller distance between chair seat 78 and the ground to accommodate their shorter legs. This user may lower chair 70 to decrease the distance between chair 70 and the ground. In some embodiments, when a user enters convertible wheelchair 10, a higher chair seat 78 can help a user to reach a seated position in wheelchair configuration 2, as chair seat 78 in a higher position is closer to their backside. Accordingly, a user may raise chair 70 prior to sitting on chair 70 when convertible wheelchair 10 is in wheelchair configuration 2. As a higher chair 70 is desirable when entering convertible wheelchair 10, a higher chair 70 may also be desirable when exiting. In some embodiments, chair 70 can be vertically adjusted to exit convertible wheelchair 10. For example, chair 70 can be raised to reach a level height with an external chair (e.g., a living room chair) or a bed to transition a user to the chair or bed. In some embodiments, chair 70 can be vertically adjusted incrementally. In some embodiments, a control can be actuated by the user to vertically displace chair 70. The control can be separate from convertible wheelchair 10, as in supported by a handheld device (e.g., a remote or a smartphone) and/or can be integrated into convertible wheelchair 10 (e.g., situated on arm rests 28).

Figure 3:
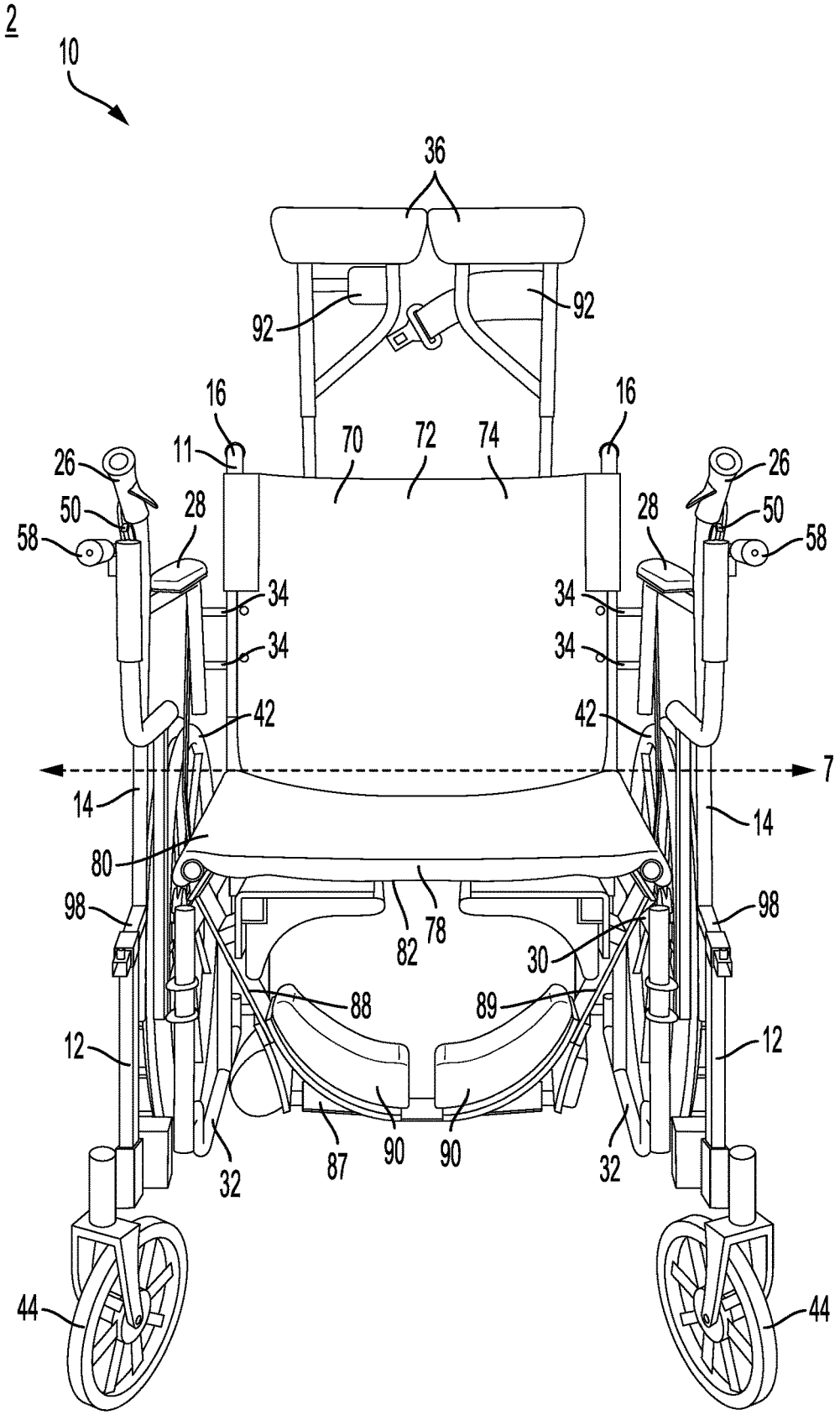
FIG. 3 shows a front side view of the convertible wheelchair of FIG. 1.
Figure 4:
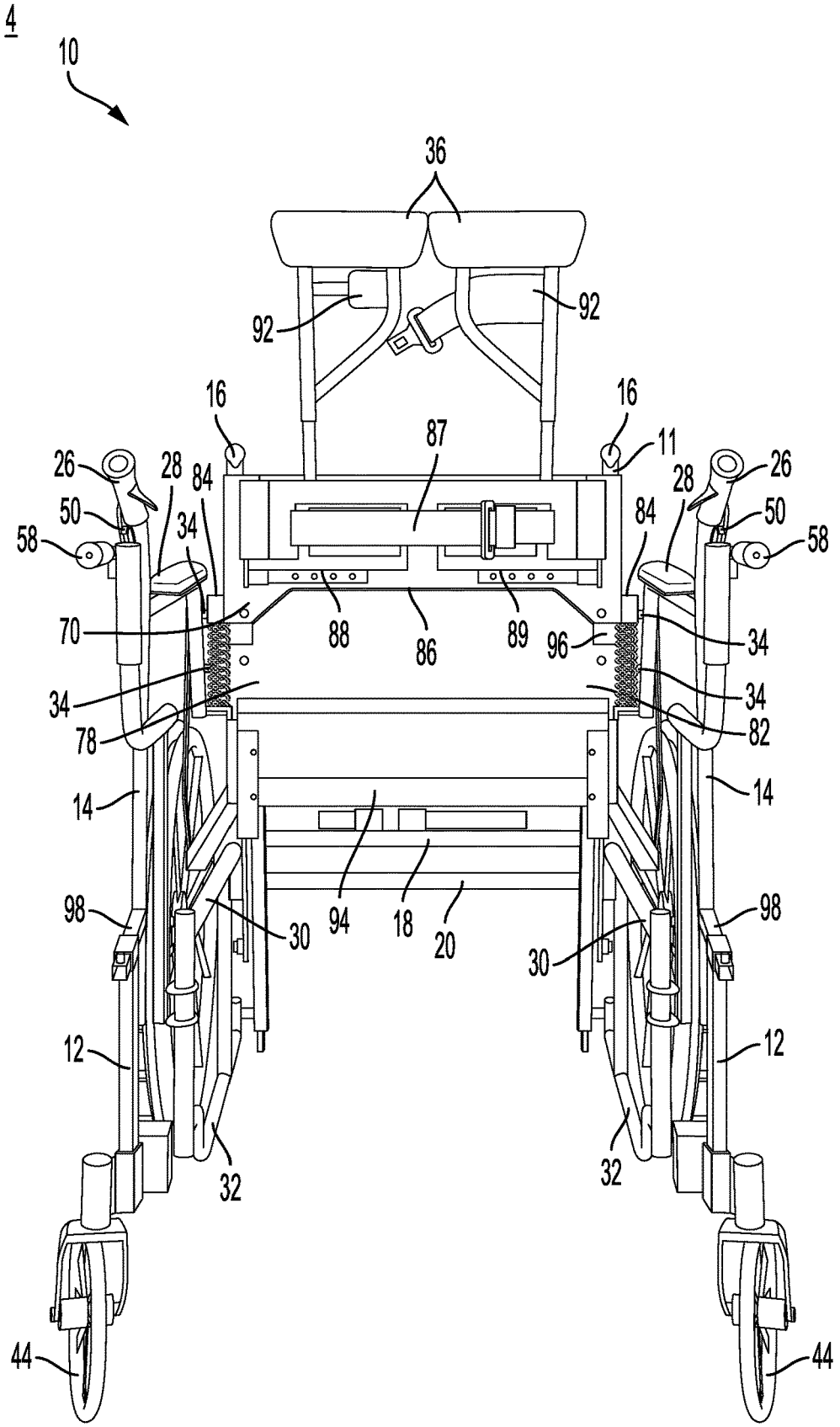
FIG. 4 shows a front side view of the convertible wheelchair of FIG. 1.

Chair 70 in a higher vertical position is shown in FIG. 3. In some embodiments, a higher chair seat 78 can also help a user exit convertible wheelchair 10 to transition to a standing position. As convertible wheelchair 10 is converted from wheelchair configuration 2 to a walker configuration 3 (FIG. 4), the user can readily lift themselves from a raised chair 70. In this way, the user does not exert as much effort to stand. In contrast, if chair 70 were lower, the user would need to lean more on their legs and support their weight to lift themselves up into a standing position. Some users who have physical limitations either are unable to lift themselves in this way or are advised to limit their physical exertion to reduce the risk of injury and preserve their health. Accordingly, the vertical adjustment of chair 70 can facilitate easier transitioning between a seated position in wheelchair configuration 2 and a standing position in walker configuration 3 (FIG. 4). Relying less on their legs by raising chair seat 78 can better support users and reduce the risk of injury.

Chair seat 78 can be rotatably coupled to chair back 72. Accordingly, in some embodiments, chair 70 can be foldable. With reference to FIGS. 3-4, chair seat 78 can be rotated in both wheelchair configuration 2 and walker configuration 4. In wheelchair configuration 2, chair seat 78 can be rotated to be generally perpendicular to chair back 72. Rotating chair seat 78 outwardly in this way can allow a user to sit in chair 70. When a user decides to stand and use walker configuration 4 of convertible wheelchair 10, the user may desire to clear the space occupied by chair seat 78. By rotating chair seat 78 to be adjacent to chair back 72, the space within convertible wheelchair 10 is cleared to allow the user to stand within convertible wheelchair 10. Because chair 70 is folded to position chair seat 78 adjacent to chair back 72, the user benefits by having additional room to move within the convertible wheelchair 10. Folding chair 70 advantageously limits the vertical extension of chair 70, which provides the user with space behind their upper legs, for example. In contrast, unfolding chair 70 such that chair seat 78 becomes coplanar with chair back 72 adds vertical extension. Chair seat 78 may extend downward toward a user's legs or ankles if chair 70 is unfolded in this way. Any contact or barrier created by chair seat 78 can impede movement. For a user who already experiences limited mobility, creating space rather than impeding movement is desirable and increases the scope of movability. By folding chair 70 such that chair seat 78 is adjacent to chair back 72, a user is better able to expand their range of motion and experience the dynamic mobility provided by convertible wheelchair 10.

As shown in FIG. 3, an axis 7 can extend along the interface between chair seat 78 and chair back 72. Chair seat 78 can be rotatable around axis 7 to move between a folded position and an unfolded position. Chair 70 in a folded position, in which chair seat 78 is adjacent to chair back 72, is shown in FIG. 4. In this position, convertible wheelchair 10 can be in walker configuration 4, in which a user can stand or walk.

In walker configuration 4, chair seat 78 can be rotated such that chair seat 78 is adjacent to chair back 72. Chair seat 78 and chair back 72 can be adjacent such that chair seat top surface 80 and chair back front surface 74 are facing each other and/or in contact. Additionally, chair seat 78 and chair back 72 can be adjacent such that angle $\alpha$ (FIG. 1) is minimized. In this way, axis 8 (FIG. 1) can be generally parallel to axis 6 (FIG. 1) and chair seat 78 and chair back 72 can be generally parallel to one another. In some embodiments, in walker configuration 4, in which a user can be in a standing or walking position, angle $\alpha$ can be between approximately 1 degree and approximately 10 degrees, such as between approximately 2 degrees and approximately 8 degrees, such as approximately 5 degrees.

Figure 5:
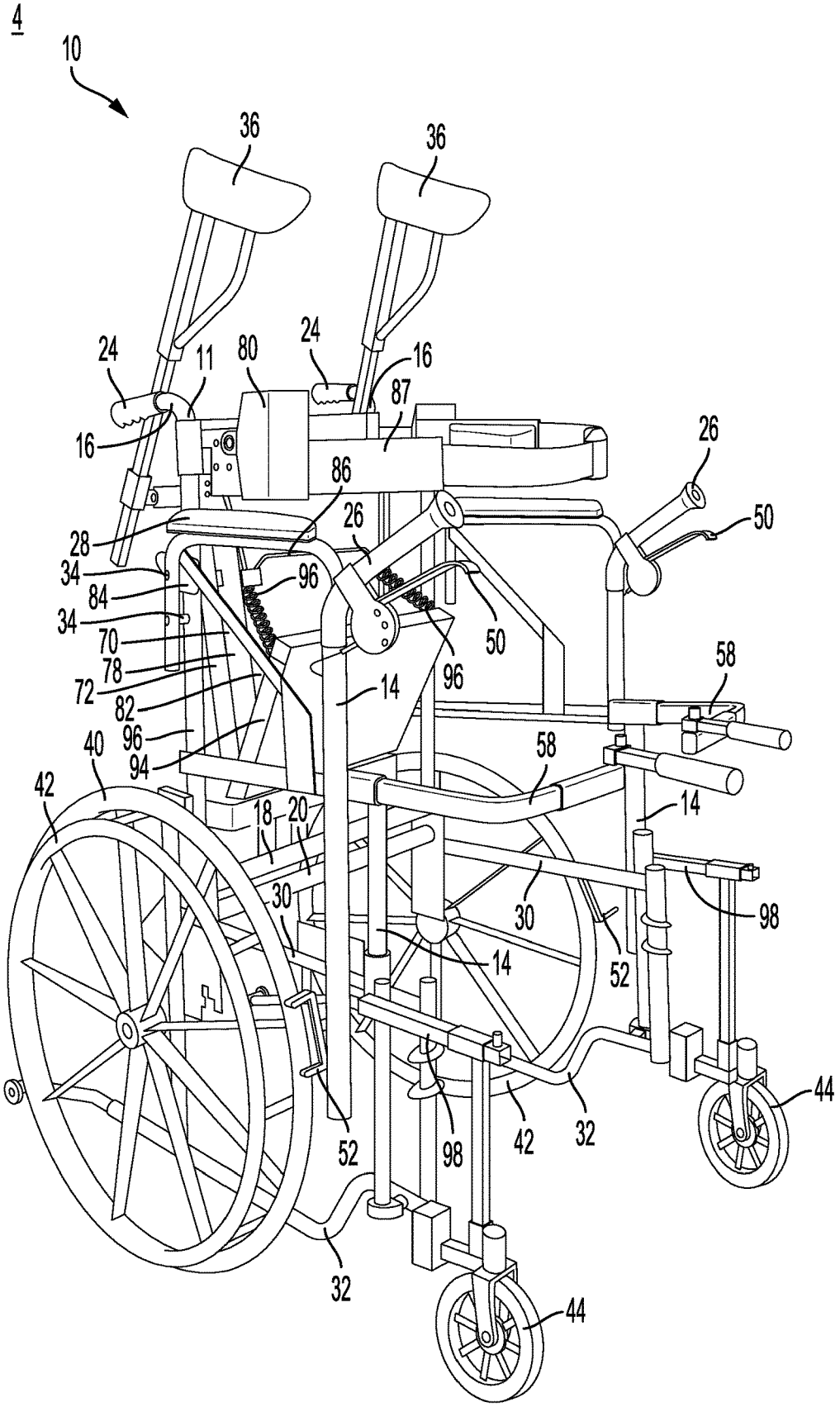
FIG. 5 shows a perspective view of the convertible wheelchair of FIG. 1.
Figure 6:
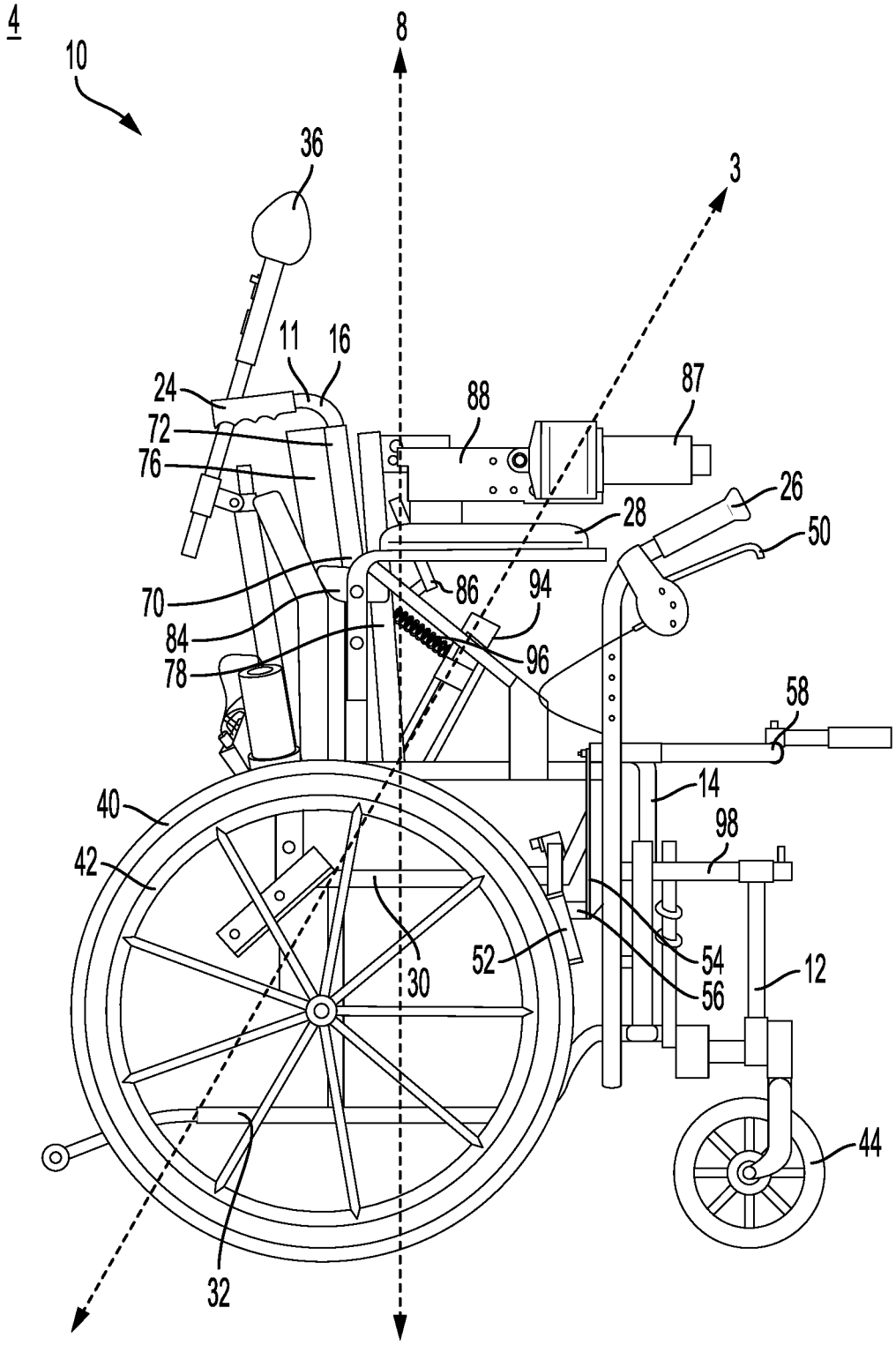
FIG. 6 shows a side view of the convertible wheelchair of FIG. 1.

Chair seat 78 can be maintained in a position that is adjacent to chair back 72. In some embodiments, chair 70 can include one or more fasteners 84. Fasteners 84 can maintain chair seat 78 adjacent to chair back 72 in walker configuration 4. Accordingly, fasteners 84 can maintain chair 70 in a folded position. As shown in FIGS. 5-6, fasteners 84 can hook onto chair seat links 34 of frame 11. In some embodiments, fasteners 84 can include openings that receive chair seat links 34 to releasably couple chair 70 to frame 11. As will be discussed further below, fasteners 84 can be releasably coupled to frame 11. In some embodiments, additionally or alternatively, chair seat 78 and chair back 72 can include hook-and-loop fasteners (e.g., Velcro™) to maintain chair seat 78 adjacent to chair back 72. By folding inwardly, chair 70 can also be compact on convertible wheelchair 10. In this way as well, chair 70 can be limited in vertical extension. As discussed above, limiting the vertical extension of chair 70 can allow chair 70 to avoid contact with the user's legs, minimizing any obstruction to the user's legs from contact. The user can experience greater freedom of movement as a result.

As with wheelchair configuration 2 (FIG. 3), chair 70 can be vertically raised in walker configuration. Chair 70 can be vertically displaced when both unfolded and folded. With reference to FIG. 5, chair 70 can be raised to position lower torso support first end 88, lower torso support second end 89, cushions 90, and lower torso support belts 87 at the vertical level of an abdomen region of the user when standing.

As shown, lower torso support first end 88, and lower torso support second end 89 can extend to a front of a torso. In some embodiments, lower torso support first end 88 and lower torso support second end 89 can be rotatably coupled to chair seat bottom surface 82 such that they can be pivoted outwardly to extend around a torso. In some embodiments, lower torso support belts 87 extending from one or more of lower torso support first end 88 and lower torso support second end 89 can extend around a front of a torso. In some embodiments, lower torso support belts 87 can secure lower torso support first end 88 and lower torso support second end 89 around a front of a torso. In some embodiments, lower torso support belts 87 can be adjustable to fit around a user's waist. For example, lower torso support first end 88 and lower torso support second end 89 can be rotated outward to provide a user with a looser fit or to accommodate a larger waist area. In this position of lower torso support first end 88 and lower torso support second end 89, lower torso support belts 87 can be long enough to secure lower torso support first end 88 and lower torso support second end 89 around a front of a torso. In some embodiments, lower torso support first end 88 and lower torso support second end 89 can be pivoted inwardly to further secure around a torso of a user. In some embodiments, lower torso support belts 87 can be hook-and-loop straps and/or can include one or more buckles, micro-adjustments, and/or hook ends. Cushions 90 can be disposed along lower torso support first end 88 and lower torso support second end 89 to provide a cushioning effect and a comfortable lower torso support to the user.

Lower torso support first end 88, lower torso support second end 89, cushions 90, and lower torso support belts 87 can be support features that individually and together secure and stabilize a user as they stand and walk. As discussed above, users of assistive devices, such as convertible wheelchair 10 described herein, may experience temporary or physical ailments that cause them to lose the ability to stand or walk without additional support. These support features in walking devices aid users in remaining upright and resisting tipping or falling. The security and stability provided by these support features also give users confidence so that they may feel equipped and able to advance their standing and walking abilities. Additionally, such features provide the user with independence. Instead of requiring a caregiver at all times to monitor the user as they stand and walk, a user can freely stand and walk with support from these features. In this way, the user can gain self-reliance and competently conduct their daily lives unattended or with minimum supervision.

With reference to FIGS. 4-7, in some embodiments, convertible wheelchair 10 can include a fall seat 94 and springs 96. Fall seat 94 can extend from chair seat 78 and can be rotatably coupled to chair seat bottom surface 82. Fall seat 94 can rotate by the falling action of the user to catch the user. In this way, fall seat 94 is a movable seat that can support the user seated of walker configuration 4. Thus, convertible wheelchair 10 described herein can provide multiple securing and stabilizing mechanisms to support the user in standing and walking positions.

As shown in FIG. 4, fall seat 94 can be coupled to chair seat bottom surface 82 at a position that is lower than the lower torso supports, e.g., lower torso support first end 88, lower torso support second end 89, cushions 90, and lower torso support belts 87 (e.g., relative to axis 8 shown in FIG. 1). With reference to FIGS. 5-6, in some embodiments, fall seat 94 is biased to be positioned adjacent to chair seat 78. In some embodiments, fall seat 94 is coupled to chair seat bottom surface 82 via springs 96. Fall seat 94 can be biased by springs 96. As shown in FIG. 6, fall seat 94 can define a plane, in which an axis 3 lies. Axis 3 can extend relative to axis 8, which lies on a plane defined by chair seat 78, at an angle $\gamma$. Chair seat 78 and fall seat 94 can be adjacent such that angle $\gamma$ is minimized. In this way, axis 3 can be generally parallel to axis 8. In some embodiments, angle $\gamma$ in wheelchair configuration 2 (e.g., FIG. 3), in which a user can be seated, and in walker configuration 4, in which a user can be in a standing or walking position, can be between approximately 1 degree and approximately 30 degrees, such as between approximately 5 degrees and approximately 20 degrees, such as approximately 15 degrees.

Figure 7:
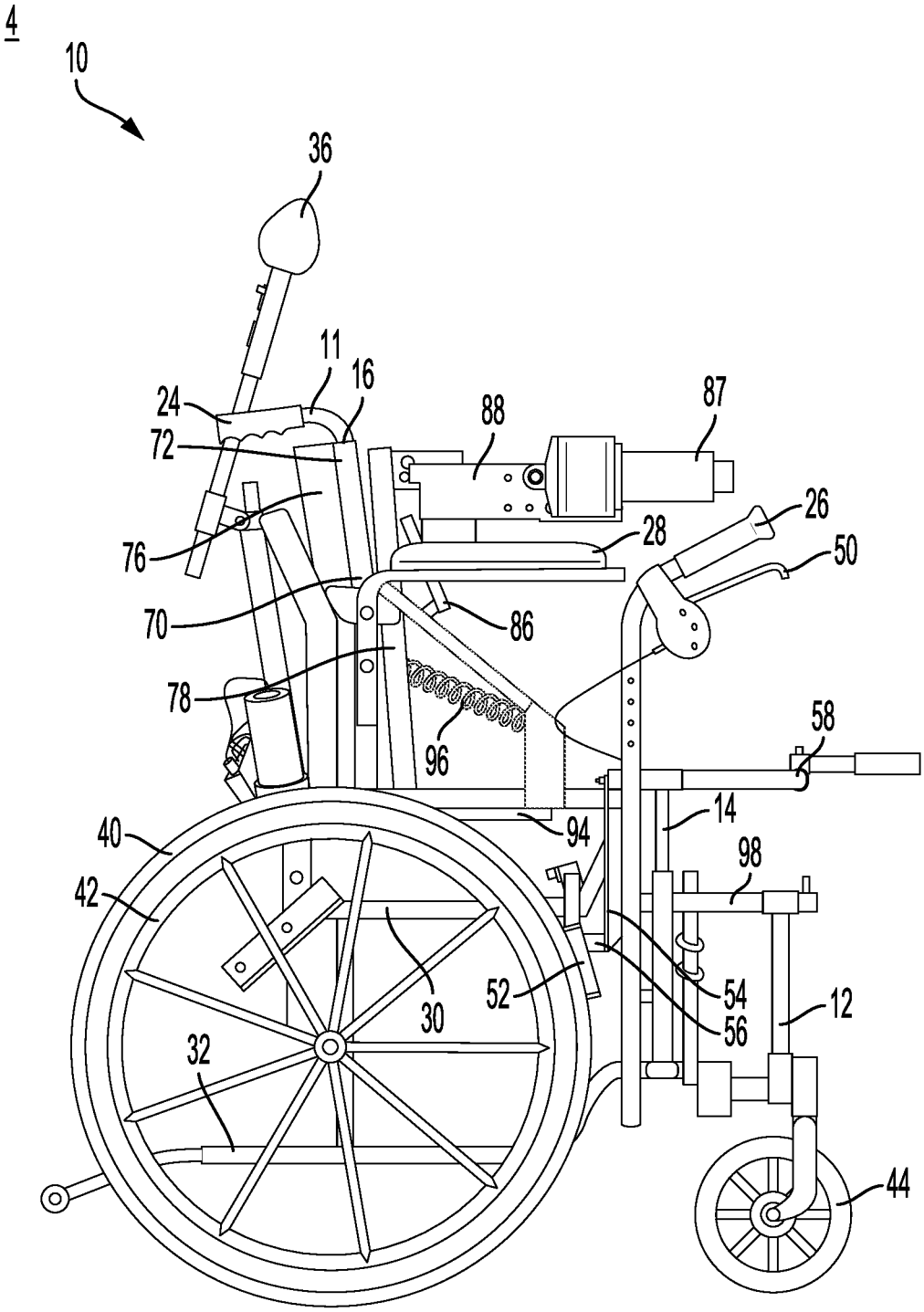
FIG. 7 shows a side view of the convertible wheelchair of FIG. 1.

If a user falls while standing or walking, fall seat 94 can rotate outwardly by the user's falling action. Accordingly, angle $\gamma$ can increase such that fall seat 94 is no longer positioned adjacent to chair seat 78. As shown in FIG. 7, angle $\gamma$ can be between approximately 70 degrees and approximately 120 degrees, such as between approximately 80 degrees and approximately 110 degrees, such as approximately 90 degrees. Accordingly, chair seat 78 and fall seat 94 can extend generally perpendicularly relative to each other. When a user desires and is able to return to a standing position, fall seat 94 can rotate to return to its biased position in which fall seat 94 is positioned adjacent to chair seat 78. In addition, the user may decide to sit while they are standing or walking to rest. Fall seat 94 can be deliberately rotated outwardly by the user to provide a seat for the user if they decide to rest, for example. The user can push into fall seat 94 with their backside to outwardly rotate fall seat 94. In some embodiments, fall seat 94 is automatically rotated to return to its biased position via springs 96. In some embodiments, fall seat 94 can be latched to chair seat 78. Fall seat 94 can be unlatched to be rotatable relative to chair seat 78. As the user returns to a standing position, fall seat 94 can be rotated to return to a position adjacent to chair seat 78. The user can then stand and move in the space previously occupied by fall seat 94 in walker configuration 4.

Chair 70 can be adjusted vertically to position chair seat 78 adjacent to a user's backside. If a user is taller, chair 70 can be raised to a greater height than if the user is shorter. In this way, fall seat 94 attached to chair seat 78 can also be ideally positioned relative to the user. If the user begins to tip or fall, or wishes to rest, their downward movement can outwardly rotate fall seat 94.

Convertible wheelchair 10 provides stability additionally with the use of brakes 52. While in walker configuration 4 or wheelchair configuration 2 (FIG. 1), the user can actuate brakes 52 to stabilize convertible wheelchair 10. In some embodiments, brakes 52 can be actuated by depressing brake handles 50. In some embodiments, brake handles 50 can extend from front handles 26. In some embodiments, brakes 52 can apply a friction force against side wheels 40 to cease movement of convertible wheelchair 10. In some embodiments, brakes 52 are coupled to brake handles 50 by vertical links 54 and horizontal links 56. In some embodiments, actuating brake handles 50 can engage brakes 52 against side wheels 40. In some embodiments, releasing brake handles 50 can disengage brakes 52 from side wheels 40. If a user begins to tip or fall while standing or walking in walker configuration 4, the user can quickly actuate brakes 52 to stop movement of convertible wheelchair 10 and reduce the risk of injury.

In some embodiments, convertible wheelchair 10 includes safety handles 58, discussed above. In some embodiments, safety handles 58 can be additional brakes positioned in front of a user of convertible wheel chair 10. As shown, in some embodiments, safety handles 58 are positioned in front of the user such that the user cannot enter or exit convertible wheelchair 10 without moving safety handles 58 out of the way. Safety handles 58 positioned in front of a user within convertible wheelchair 10 can indicate that convertible wheelchair 10 (and a user positioned in convertible wheelchair 10) is mobile. Safety handles 58 also provide grasping surfaces for the user. The user can grip safety handles 58, as convertible wheelchair 10 is mobile to feel control and security over the device. In some embodiments, front handles 26 and/or safety handles 58 may be used by a user to step into and out of a vehicle, on or off a commode, on or off a separate chair or other seat, etc.—without assistance. As discussed above, the security and stability provided by these support features also give users confidence so that they may feel equipped and able to advance their standing and walking abilities. Additionally, such features provide the user with independence. Instead of requiring a caregiver at all times to monitor the user as they stand and walk, a user can freely stand and walk with support from these features. In this way, the user can gain self-reliance and competently conduct their daily lives unattended or with minimum supervision.

In some embodiments, if a user is in convertible wheelchair 10 in wheelchair configuration 2 (FIG. 1), the user must exit convertible wheelchair 10 to convert convertible wheelchair 10 to walker configuration 4. Once convertible wheelchair 10 is in walker configuration 4, the user can reenter convertible wheelchair 10. Similarly, in some embodiments, if a user is in convertible wheelchair 10 in walker configuration 4, the user must exit convertible wheelchair 10 to convert convertible wheelchair 10 to wheelchair configuration 2 (FIG. 1). Once convertible wheelchair 10 is in wheelchair configuration 2 (FIG. 1), the user can reenter convertible wheelchair 10. In some embodiments, safety handles 58 must be rotated away to permit a user to exit or enter convertible wheelchair 10. In some embodiments, when safety handles 58 are rotated away (e.g., towards side wheels 40), brakes 52 can be actuated via vertical links 54 and horizontal links 56 to immobilize convertible wheelchair 10. Immobilizing convertible wheelchair 10 allows a user to enter and exit while convertible wheelchair 10 is stabilized. As discussed, safety handles 58 provide grasping surfaces as well. Accordingly, as a user enters and exits convertible wheelchair 10, they may grip safety handles 58 for support. By leveraging safety handles 58 while convertible wheelchair 10 is stabilized, users can lift themselves out of or lower themselves into convertible wheelchair 10 without fear of losing control of the same. In this way, as a user positions themselves in walker configuration 4 or wheelchair configuration 2 (FIG. 1), the user can feel secure, and any potential injury is minimized or prevented. Additional examples of safety handles 58 are found in U.S. Pat. No. 6,431,572 B1, the disclosure of which is hereby incorporated herein by reference in its entirety.

Figure 8:
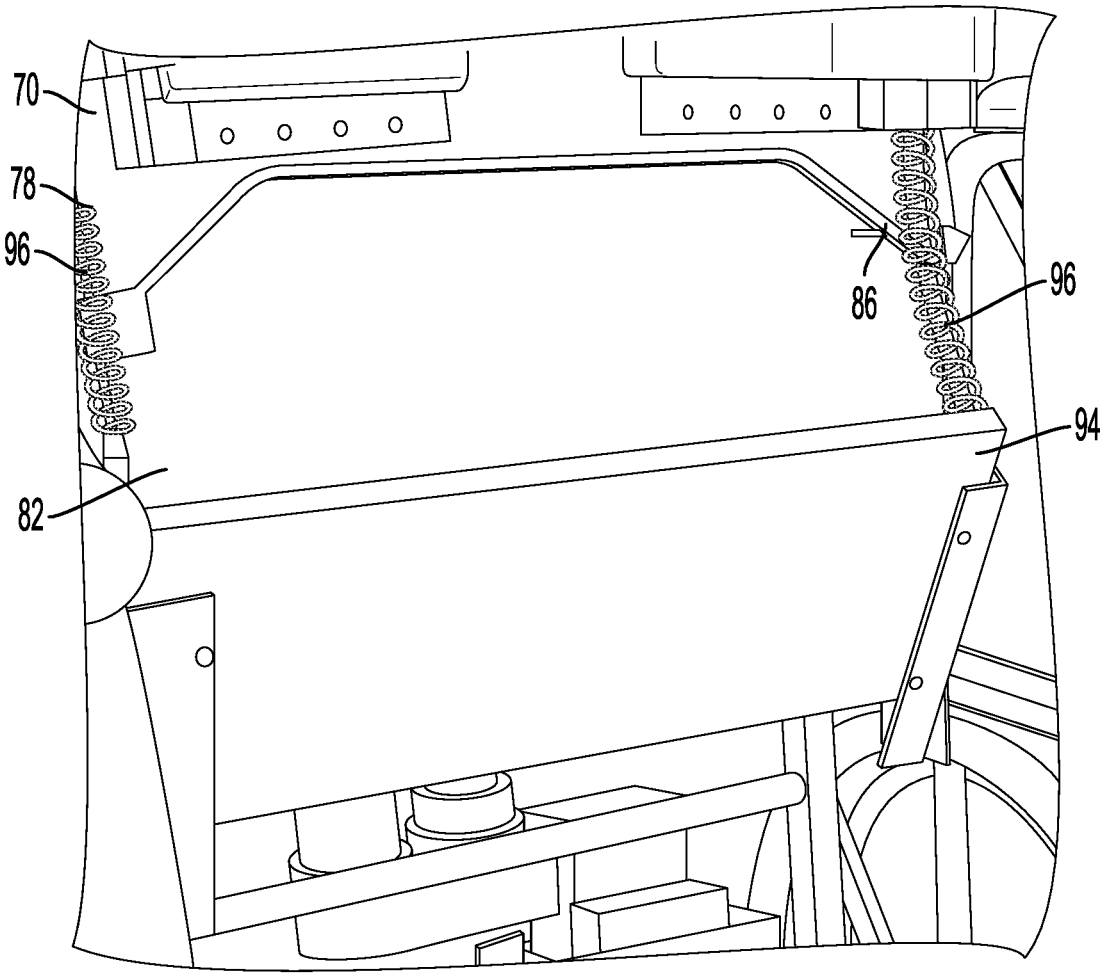
FIG. 8 shows a perspective view of a fall seat of the convertible wheelchair of FIG. 1.
Figure 9:
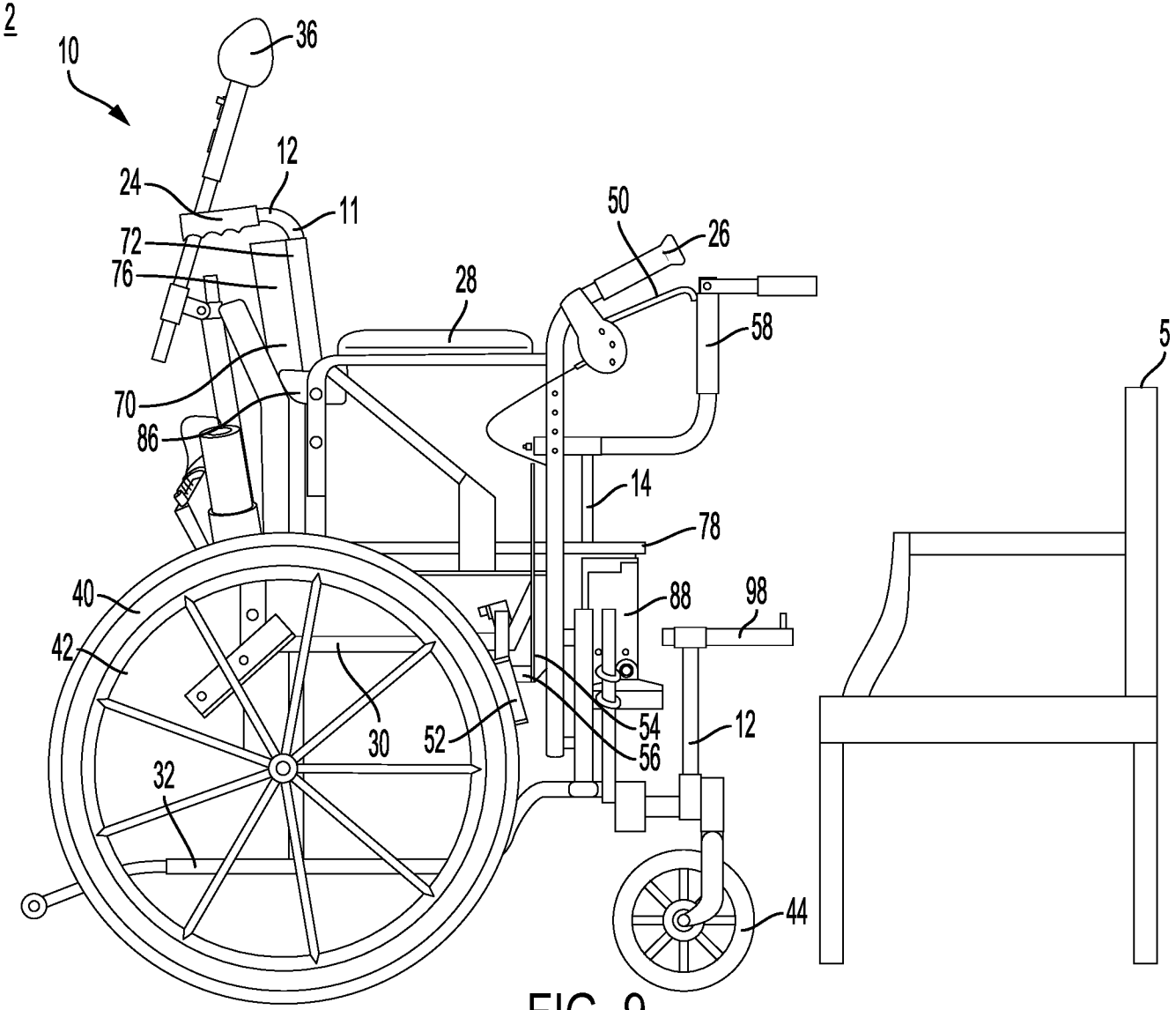
FIG. 9 shows a side view of the convertible wheelchair of FIG. 1.

Shifting convertible wheelchair 10 between wheelchair configuration 2 (FIG. 1) and walker configuration 4 can be simple such that a user can complete the conversion independently. As shown in FIG. 8, convertible wheelchair 10 can include a fastener release 86. In some embodiments, fastener release 86 can remove fastener 84 from chair seat link 34. In some embodiments, fastener release 86 can be a lever coupled to fastener 84 such that lifting fastener release 86 can remove fastener 84 from chair seat link 34. By removing fastener 84 from chair seat link 34, convertible wheelchair 10 can be returned to wheelchair configuration 2 (e.g., FIG. 3). With reference to FIG. 9 and as discussed above, in wheelchair configuration 2, a user can be seated as chair back 72 and chair seat 78 can extend generally perpendicularly relative to each other. Additionally, chair 70 can be vertically lowered to provide a comfortable and practical seated position for the user. For example, chair 70 can be lowered if a user is shorter to decrease the distance between chair 70 and the ground. Similarly, chair 70 can be vertically raised, such as if the user is taller and desires a greater distance between chair 70 and the ground.

In some embodiments, a user can independently shift convertible wheelchair 10 between wheelchair configuration 2 and walker configuration 4 without the use of their arms. In some embodiments, chair seat 78 can be rotatable relative to chair back 72 similar to how fall seat 94 is rotatable relative to chair seat 78. In some embodiments, chair seat 78 can be biased to be adjacent to chair back 72. In some embodiments, this biasing can be in lieu of the engagement between fastener 84 and chair seat link 34. As a user desires to be seated in wheelchair configuration 2, the user can push into chair seat 78 with their backside to outwardly rotate chair seat 78. The user can then sit in chair 70 to maintain chair seat 78 in a generally perpendicular position relative to chair back 72. To transition convertible wheelchair 10 to walker configuration 4, the user can move safety handles 58 positioned in front of the user when the user seated within convertible wheelchair 10. Instead of using their hands, the user can use another body part to move safety handles 58 away to exit convertible wheelchair 10. Once the user is no longer maintaining chair seat 78 in a generally perpendicular position relative to chair back 72 by being seated in chair 70, chair seat 78 can be rotated to return to a position adjacent to chair seat 78. The user can then stand and move in the space previously occupied by fall seat 94 in walker configuration 4. Accordingly, users who do not have the capability of using their hands can also utilize convertible wheelchair 10 for increased mobility.

Frame 11 can provide additional stability features to users of convertible wheelchair 10. As shown in FIG. 9 and as discussed above, in some embodiments, frame 11 can include stability bars 98 extending from front vertical members 12. Stability bars 98 can extend forwardly from convertible wheelchair 10 and can be positioned lower to the ground relative to arm rests 28 and chair 70, for example. As shown in relation to a chair 5, stability bars 98 can provide leverage for a user as they transition between chair 70 of convertible wheelchair 10 to chair 5 (which can be, for example, a car seat, a hospital wheelchair, a bed, a living room chair, etc.). Accordingly, a user can safely and securely move from a seated position in wheelchair configuration 2 to a seated position external to convertible wheelchair 10 by grasping and leveraging stability bars 98. Similarly, a user can safely and securely move from a seated position external to convertible wheelchair 10 to a seated position in wheelchair configuration 2 to by grasping stability bars 98. In some embodiments, stability bars 98 can be rotatable on front vertical members 12. In this way, a user is provided with stability features in a more forward position relative to other parts of frame 11 as they move closer to chair 5. Stability bars 98 and/or safety handles 58 also provide grasping surfaces for the user. The user can grip stability bars 98 and/or safety handles 58, as convertible wheelchair 10 is mobile to feel control and security over the device. In some embodiments, front handles 26 and/or stability bars 98 and/or safety handles 58 may be used by a user to step into and out of a vehicle, on or off a commode, on or off a separate chair or other seat, etc.—without assistance. As discussed above, the security and stability provided by these support features also give users confidence so that they may feel equipped and able to advance their standing and walking abilities. Additionally, such features provide the user with independence. Instead of requiring a caregiver at all times to monitor the user as they stand and walk, a user can freely stand and walk with support from these features. In this way, the user can gain self-reliance and competently conduct their daily lives unattended or with minimum supervision.

Figure 10:
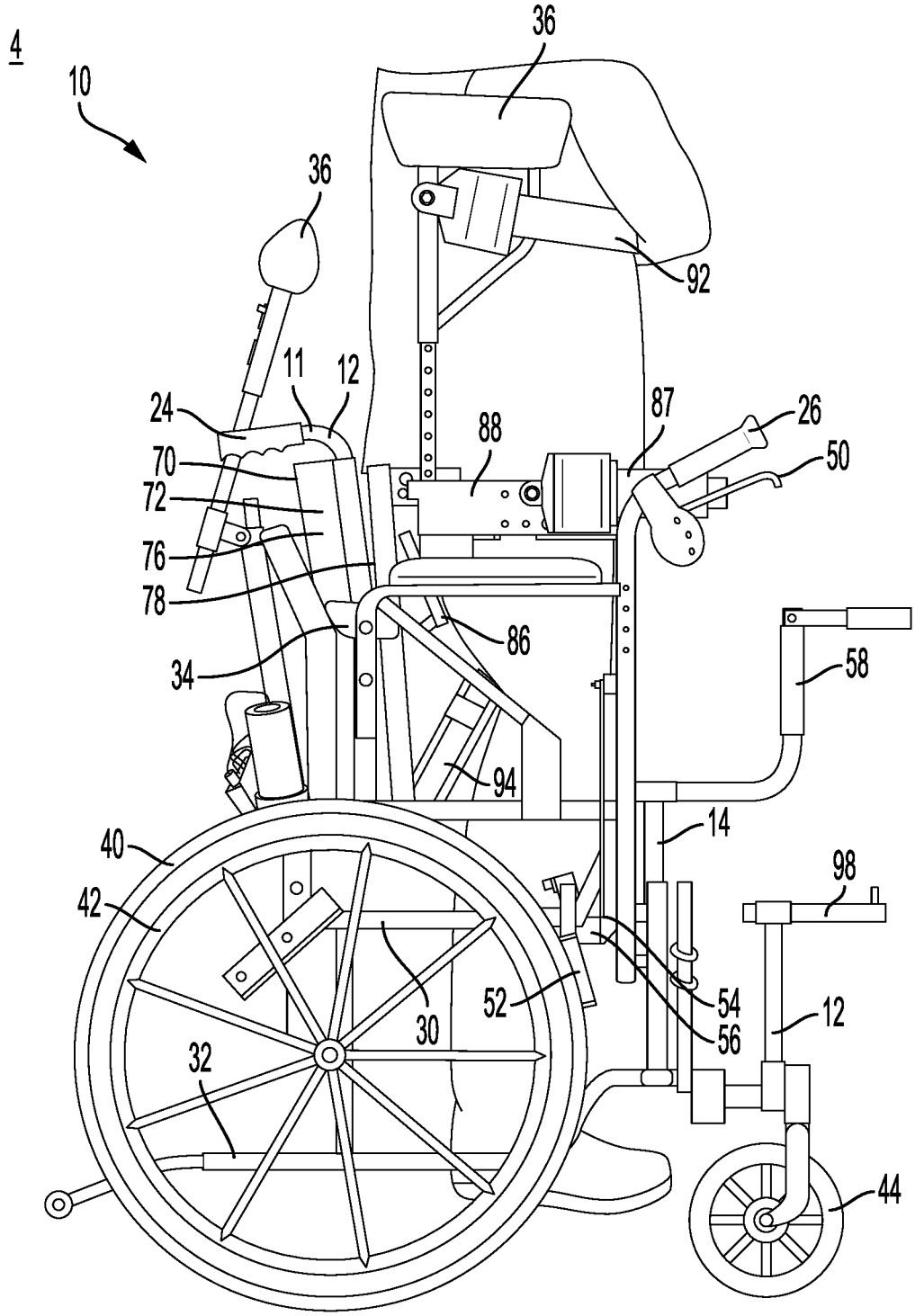
FIG. 10 shows a side view of the convertible wheelchair of FIG. 1.

As shown in FIG. 10, convertible wheelchair in walker configuration 4 can support a user as they are standing or walking. To provide additional support, in some embodiments, crutches 36 can be used. Instead of removing crutches 36 from convertible wheelchair 10, a user can maintain crutches 36 in a position adjacent to chair back 72 in walker configuration 4. As shown, a user can position crutches 36 under their arms for additional standing and walking stability. In some embodiments, a second torso support can be coupled to crutches 36. In some embodiments, crutches 36 can support upper torso support belts 92. In some embodiments, upper torso support belts 92 can be a belt similar to lower torso support belts 87. In some embodiments, upper torso support belts 92 can secure around a front of a torso. In some embodiments, upper torso support belts 92 can be hook-and-loop straps and/or can include one or more buckles, micro-adjustments, and/or hook ends. In some embodiments, upper torso support belts 92 can be adjustable to provide a user with a looser fit or to accommodate a larger waist area. In some embodiments, torso support belts 92 and/or 87 may be coupled to convertible wheelchair 10 via a track and/or rollers. In this way, if a user wishes to sit or stand while torso support belts 92 are closed, the torso support belts 92 and/or 87 may comfortably follow the user's torso as they sit or stand. In some embodiments, stability bars 98 are not included, and instead the torso support belts 92 and/or 87 are used alone. In some embodiments, torso support belts 92 and/or 87 may be coupled to convertible wheelchair 10 via a lever and/or spring. Similarly, if a user wishes to sit or stand while torso support belts 92 are closed, the torso support belts 92 and/or 87 may comfortably follow the user's torso as they sit or stand. This additionally prevents torso support belts 92/87 from binding when sitting down, and prevents the user from sliding down inside the torso support belts 92/87 when sitting. In some embodiments, stability bars 98 are not included, and instead the torso support belts 92 and/or 87 are used alone Upper torso support belts 92 can be positioned above the lower torso supports, e.g., lower torso support first end 88, lower torso support second end 89, cushions 90, and lower torso support belts 87 (e.g., relative to axis 8 shown in FIG. 1). Accordingly, upper torso support belts 92 can secure around an area of a torso above an abdomen region of a user, e.g., a chest region. Including upper torso support belts 92 provides additional stability and support to users to reduce the risk of them tipping or falling and potential injury. By reducing this risk, users are able to be mobile with less assistance (e.g., from caregivers or healthcare professionals). The security provided by multiple torso supports can give users the confidence to freely stand and walk. Further, the torso supports described herein (e.g., upper torso support belts 92, lower torso support first end 88, lower torso support second end 89, cushions 90, and lower torso support belts 87) can be secured entirely around a torso of a user. Accordingly, the user can be retained within the torso supports such that the user does not need to grasp a structure to limit or reduce the risk of tipping or falling. This can be advantageous for users who lack the ability to quickly and/or instinctively catch themselves. The torso supports can also be quickly engaged and disengaged. In this way, a user can quickly and easily convert convertible wheelchair 10 from wheelchair configuration 1 (FIG. 1) and walker configuration 4 to support dynamic movement. In some embodiments, conversion of convertible wheelchair 10 from wheelchair configuration 1 (FIG. 1) and walker configuration 4 can take less than approximately two minutes, such as approximately one minute, such as approximately 30 seconds.

Figure 11:
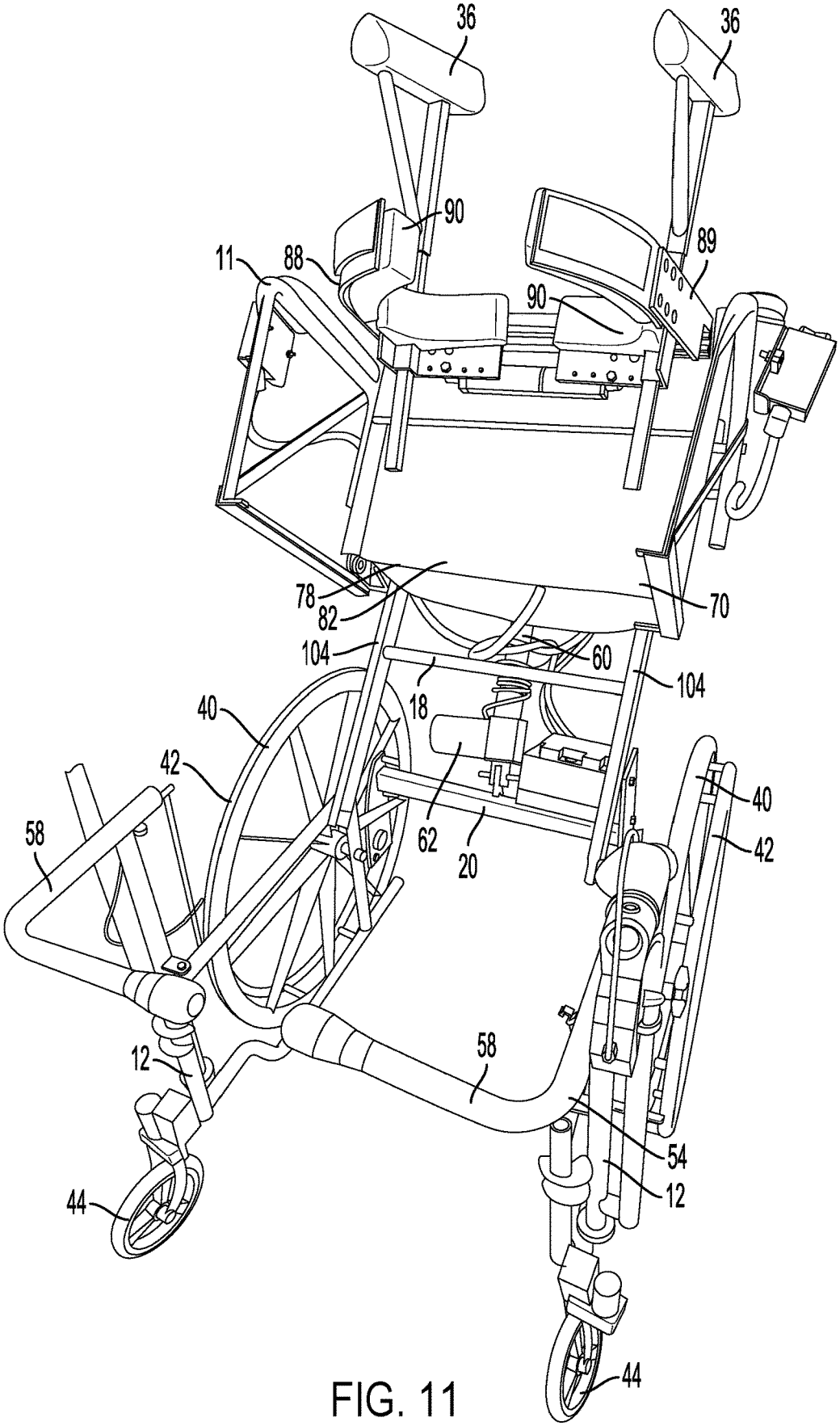
FIG. 11 shows a perspective view of a convertible wheelchair according to some embodiments.
Figure 12:
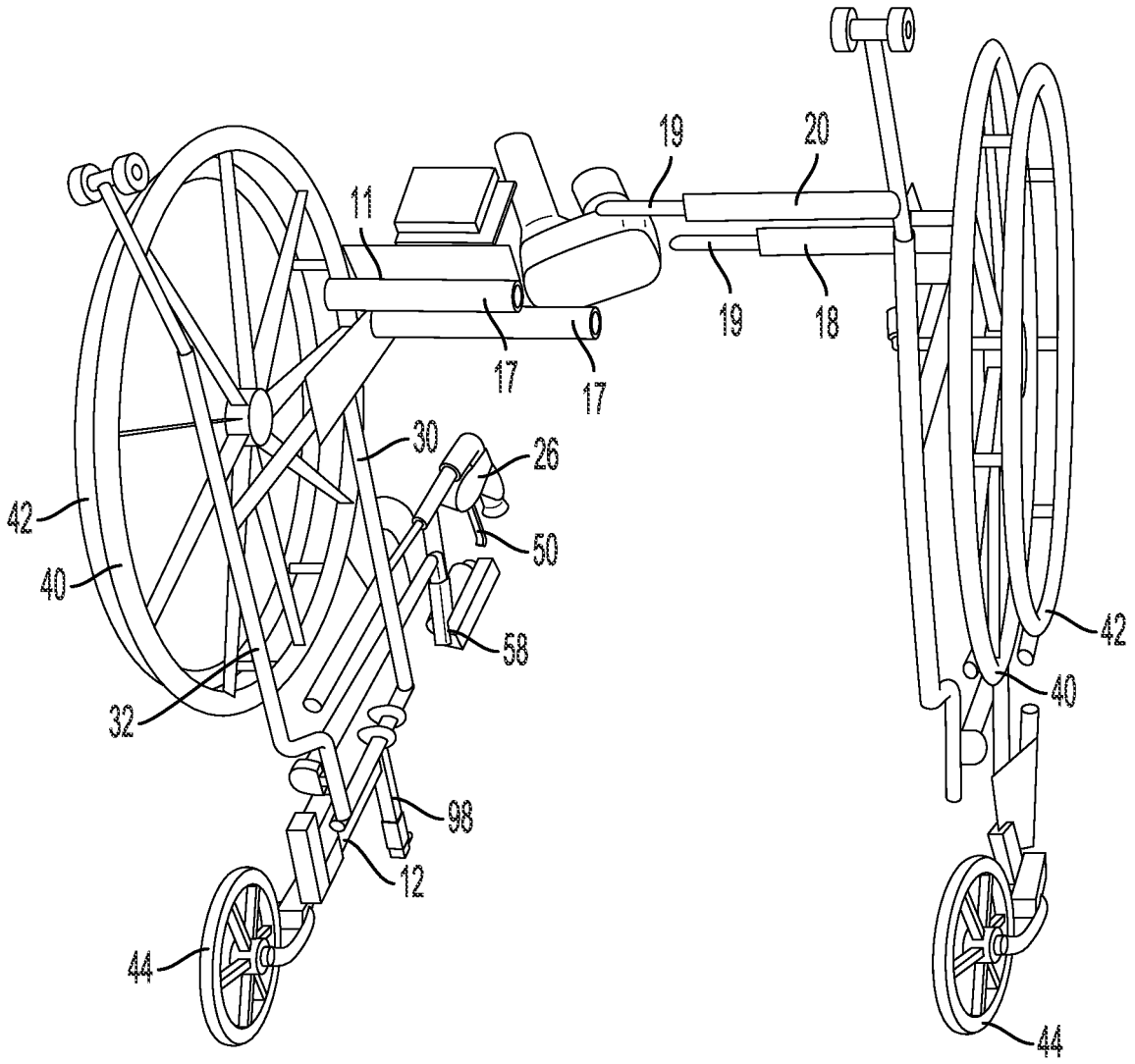
FIG. 12 shows a perspective view of the convertible wheelchair of FIG. 11.

In addition to providing an advanced assistive device, convertible wheelchair 10 can be convenient to use. With reference to FIGS. 11-12, convertible wheelchair 10 can be modular. As discussed above, convertible wheelchair 10 can be taken apart easily for compact storage. This configuration can be advantageous in applications where users require frequent transportation, such as for hospital or rehabilitation visits. As shown in FIG. 11, frame 11 can be detached to remove chair 70. Frame 11 can support vertical supports 104, which can be lifted from frame 11 to detach chair 70. As shown in FIG. 12, frame can additionally include back support frame member holes 17 and back support member rods 19. Each of intermediate back member 18 and lower back member 20 can include a back support frame member hole 17 and a back support member rod 19. Back support member rod 19 can be inserted into back support frame member hole 17 for assembly. Similarly, back support member rod 19 can be inserted into back support frame member hole 17 to disassemble frame 11. Based on the foregoing, convertible wheelchair 10 can be easily and quickly taken apart to stack and store smaller assemblies.

Figure 13:
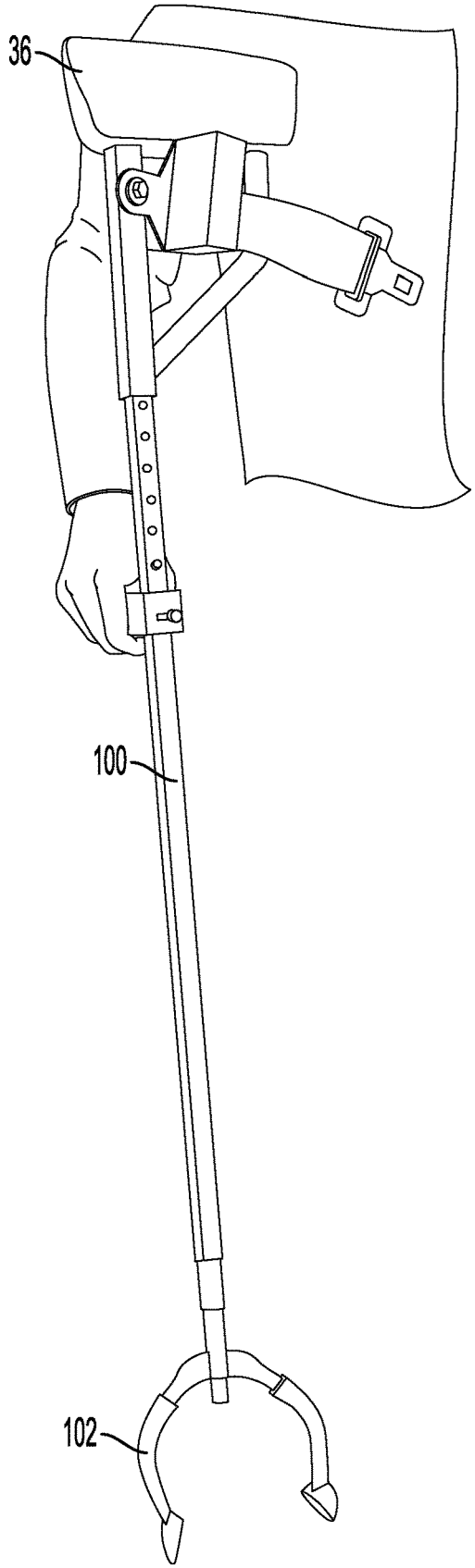
FIG. 13 shows a perspective view of a crutch of the convertible wheelchair of FIG. 1 and a walking stick according to some embodiments.

As shown in FIG. 13, in some embodiments, crutches 36 can be removed from convertible wheelchair 10 (FIG. 1). In some embodiments, convertible wheelchair 10 (FIG. 1) can also include walking sticks 100. In some embodiments, crutches 36 can be removed and inserted into walking sticks 100 to support walking without use of walking configuration 4 of convertible wheelchair 10. Accordingly, users can have additional flexibility to walk without the use of walking configuration 4 of convertible wheelchair 10. In some embodiments, walking sticks 100 can support removable grips 102. Removable grips 102 can be used to grab items that are out of reach, such as overhead items. Crutches 36 with walking sticks 100 and removable grips 102 can additionally be used in wheelchair configuration 2 (FIG. 1) and walker configuration 4 (FIG. 4) to facilitate reaching items while sitting, standing, and walking as well. In this way, users can have tools and accessories to support their dynamic mobility.

In some embodiments, convertible wheelchair 10 can be provided in a kit. The kit can include the parts of convertible wheelchair 10 for assembly. In some embodiments, a conversion kit can be available with tools and/or parts to convert an existing assistive device into convertible wheelchair 10 described herein.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A convertible wheelchair having a wheelchair configuration and a walker configuration, the convertible wheelchair comprising:

a frame;

a chair supported by the frame, the chair comprising:

a chair back, and a chair seat rotatably coupled to the chair back, the chair seat positioned at an angle relative to the chair back in the wheelchair configuration and positioned adjacent to the chair back in the walker configuration; and a torso support attached to and extending from a bottom surface of the chair seat, the torso support configured to secure around a front of a torso.

2. The convertible wheelchair of claim 1, further comprising:

a fastener configured to maintain the chair seat adjacent to the chair back in the walker configuration.

3. The convertible wheelchair of claim 2, wherein the fastener is further configured to releasably couple to the frame to maintain the chair seat adjacent to the chair back in the walker configuration.

4. The convertible wheelchair of claim 1, further comprising:

a second torso support configured to secure around a front of a torso.

5. The convertible wheelchair of claim 4, wherein the torso support is a first torso support and is configured to secure around an abdomen region, and wherein the second torso support is positioned above the first torso support.

6. The convertible wheelchair of claim 1, wherein the torso support comprises:

two opposing ends configured to extend to a front of a torso.

7. The convertible wheelchair of claim 6, wherein the torso support further comprises:

a belt extending from the opposing ends, the belt configured to secure the torso support around the front of the torso.

8. A convertible wheelchair having a wheelchair configuration and a walker configuration, the convertible wheelchair comprising:

a foldable chair comprising:

a chair back, and a chair seat coupled to the chair back, the chair seat adjustable to be positioned adjacent to the chair back in the walker configuration; and an elevating mechanism coupled to the chair back, the elevating mechanism configured to vertically displace the foldable chair in both the wheelchair configuration and the walker configuration, wherein the elevating mechanism is configured to vertically displace the foldable chair in both an unfolded position and a folded position of the foldable chair.

9. The convertible wheelchair of claim 8, further comprising:

a torso support configured to secure around a front of a torso, the torso support attached to and extending from the chair seat.

10. The convertible wheelchair of claim 9, wherein the elevating mechanism is further configured to vertically displace the foldable chair to position the torso support at an abdomen region of a user of the convertible wheelchair in the walker configuration.

11. The convertible wheelchair of claim 8, further comprising:

a crutch positioned adjacent to the chair back.

12. The convertible wheelchair of claim 11, further comprising:

a torso support coupled to the crutch and configured to secure around a front of a torso.

13. The convertible wheelchair of claim 8, further comprising:

opposing stability bars positioned below the foldable chair and extending parallel to the chair seat in an unfolded position of the foldable chair, the opposing stability bars configured to provide stability support to a user of the convertible wheelchair in the wheelchair configuration.

14. The convertible wheelchair of claim 8, wherein the foldable chair is removably coupled to a frame of the convertible wheelchair such that the convertible wheelchair is modular.

15. A foldable chair for a mobility device, the foldable chair comprising:

a chair back;

a chair seat coupled to the chair back, the chair seat configured to support a user of the mobility device in the seated configuration and to rotate to move the foldable chair between a folded position and an unfolded position, wherein when the user stands up, the chair seat automatically moves towards the chair back away and upward such that the user may stand in the space previously occupied by the chair seat; and a fall seat, wherein the fall seat is biased to be positioned adjacent to the chair seat.

16. The foldable chair of claim 15, wherein the chair seat comprises an actuator configured to maintain the foldable chair in the folded position.

17. The foldable chair of claim 15, further comprising:

a torso support configured to secure around a front of a torso, the torso support attached to and extending from the chair seat.

18. The foldable chair of claim 17, wherein the torso support is attached to the chair seat at a position above a fall seat.

19. A foldable chair for a mobility device, the foldable chair comprising:

a chair back;

a chair seat coupled to the chair back, the chair seat configured to support a user of the mobility device in the seated configuration and to rotate to move the foldable chair between a folded position and an unfolded position, wherein when the user stands up, the chair seat automatically moves towards the chair back away and upward such that the user may stand in the space previously occupied by the chair seat; and a torso support configured to secure around a front of a torso, the torso support attached to and extending from the chair seat.

* * * * *